US005468601A

United States Patent [19]

Wen

[11] Patent Number: 5,468,601

[45] Date of Patent: Nov. 21, 1995

[54] DEPOSITION SENSITIZED EMULSIONS AND PROCESSES FOR THEIR PREPARATION

[75] Inventor: Xin Wen, Rochester, N.Y.

[73] Assignee: Eastman Kodak Company, Rochester, N.Y.

[21] Appl. No.: 226,584

[22] Filed: Apr. 12, 1994

[51] Int. Cl.[6] ..... G03C 1/035

[52] U.S. Cl. ..... 430/567; 430/569

[58] Field of Search ..... 430/567, 569

[56] References Cited

U.S. PATENT DOCUMENTS

| | | | |
|---|---|---|---|
| 4,435,501 | 3/1984 | Maskasky | 430/434 |
| 4,463,087 | 7/1984 | Maskasky | 430/567 |
| 4,471,050 | 9/1984 | Maskasky | 430/567 |
| 5,275,930 | 1/1994 | Maskasky | 430/567 |

FOREIGN PATENT DOCUMENTS

0498302A1 8/1992 European Pat. Off. .

OTHER PUBLICATIONS

Shiozawa, "Bull. Soc. Photogr. Sci. Technol. Japan", No. 22, 14–20 (1972).

*Primary Examiner*—Charles L. Bowers, Jr.
*Assistant Examiner*—Mark F. Huff
*Attorney, Agent, or Firm*—Carl O. Thomas

[57] ABSTRACT

A process is disclosed for the precipitation of a silver halide emulsion containing host grains having {100} crystal faces that are sensitized by the deposition of protrusions at the intersections of the {100} crystal faces. Protrusion growth is achieved by undertaking final silver introduction in the presence of a benzothiazolium site director containing a 5-position electron withdrawing ring substituent adsorbed to the {100} crystal faces of the grains being grown.

13 Claims, 2 Drawing Sheets

1 μm

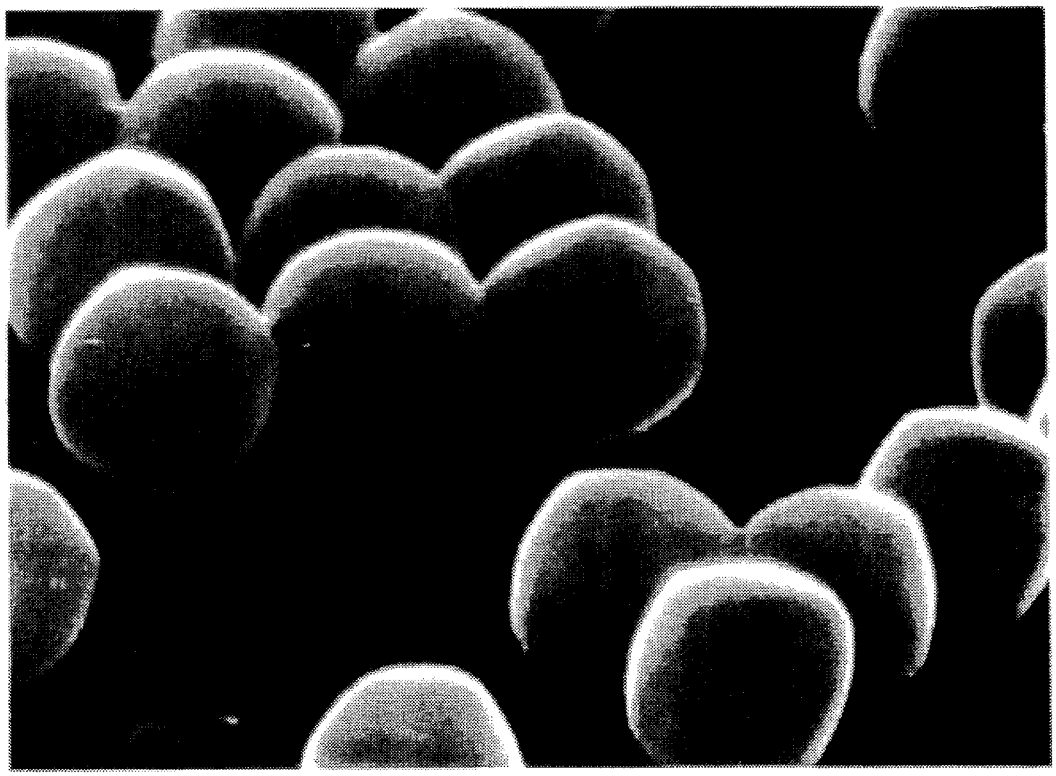
FIG. 2 (CONTROL) 1 μm
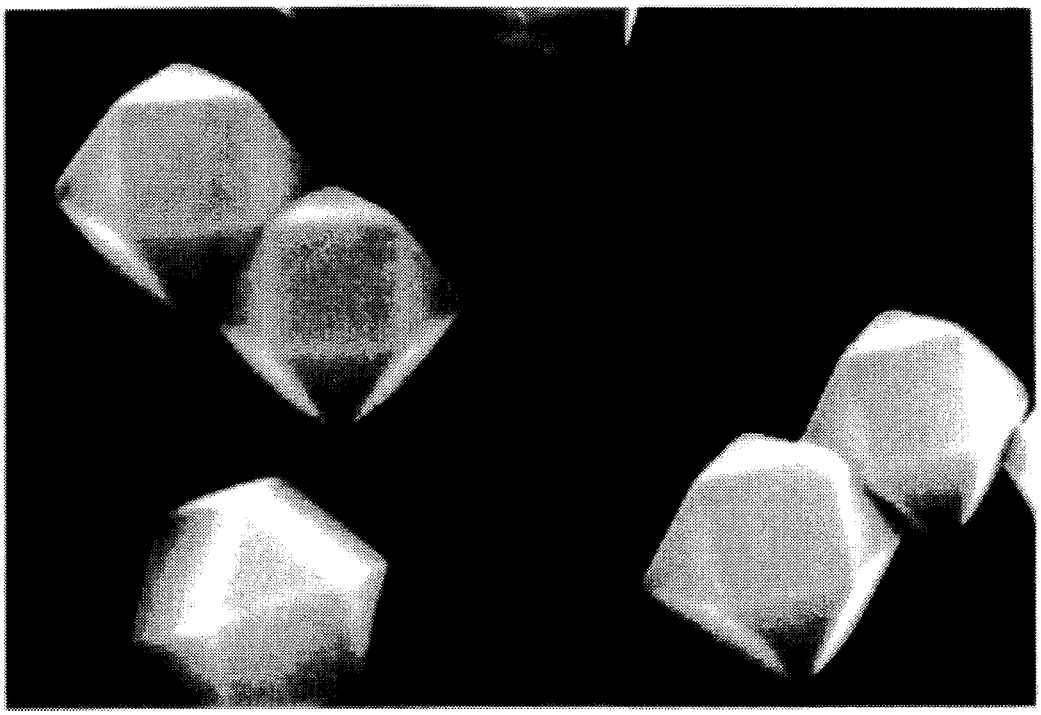
FIG. 3 (CONTROL) 1 μm

DEPOSITION SENSITIZED EMULSIONS AND PROCESSES FOR THEIR PREPARATION

FIELD OF THE INVENTION

The invention relates to photographic emulsions and to processes for their preparation.

BACKGROUND OF THE INVENTION

Photographic emulsions rely on silver halide grains for light sensitivity. The light sensitive silver halide grains exhibit a face centered cubic crystal lattice structure that typically forms {111} or {100} crystal faces. Silver chloride and silver bromide both form face centered cubic crystal lattice structures. Photographically useful grains can consist of silver chloride, silver bromide and any combination of these two silver halides. Silver iodide under the grain precipitation conditions employed for preparing photographic emulsions does not form a face centered cubic crystal lattice structure and hence does not form grains having {111} or {100} crystal faces. Silver iodide nevertheless can be accommodated in minor proportions in grains having {111} or {100} crystal faces. In grains composed of two or more halides the halides are named in their order of ascending concentrations.

Maskasky U.S. Pat. Nos. 4,435,501, 4,463,087 and 4,471,050 demonstrated that the epitaxial deposition of a silver salt onto the corners or edges of host silver halide grains can produce emulsions of increased sensitivity. In Maskasky '501 and '087 silver halides forming face centered cubic crystal lattice structures and hence isomorphic (x, y and z unit cell axes of equal length) silver halides are disclosed to be directed onto the edges and/or corners of host grains having {111} crystal faces by relying on one or a combination of (a) bulk iodide in the host grain, (b) adsorbed iodide on the surface of the host grain, and (c) adsorbed dye capable of acting as a deposition site director. In Maskasky '050 it was observed that nonisomorphic (lacking a face centered cubic crystal lattice structure) silver salts can be deposited onto the edges and corners of host grains having {111} or {100} crystal faces even in the absence a site director.

Chen et al EPO 0 498 302 A1 discloses preparing emulsions with protrusions having a higher solubility than the host grains to improve developability. The protrusions can be distributed over the grain faces or, by using one of the types of site directors taught by Maskasky, cited above, can be directed to the edges or corners of the grains. In the examples the host grains are stated to be octahedral. That is, they are regular grains having eight {111} crystal faces.

Maskasky U.S. Pat. No. 5,275,930 discloses the formation of high (>50 mole %) chloride tabular grains having {100} major faces which are increased in sensitivity by depositing at one or more of their corners a silver halide that contains less than 75 percent of the chloride ion concentration of the host grains. The purpose of limiting the chloride concentration of the epitaxy is to decrease its solubility in relation to the solubility of the host grains. This insures that the epitaxy is confined to the corners of the host grains rather than spreading over the host grain surface, thereby dissipating the increase in sensitivity being sought. Even with the lower solubility halide composition of the epitaxy Maskasky suggests employing morphological stabilizers, including compounds such as benzothiazole, to minimize spreading of the epitaxy over the host grain surfaces in the heating step that occurs during chemical sensitization.

SUMMARY OF THE INVENTION

Prior to the present invention the art in attempting to increase emulsion sensitivity by depositing silver halide selectively at the edges or corners of host grains has been restricted to (a) choosing a host grain having {111} crystal faces, (b) employing a nonisomorphic silver salt for edge or corner deposition, or (c) employing an isomorphic silver halide for edge or corner deposition that is of lower solubility than the silver halide of a host grain having {100} faces. Choice (a) has the disadvantage that it limits the morphology of the host grain. This choice is particularly restrictive when the host grain composition is contains high levels of chloride, since silver chloride strongly favors the formation of grains having {100} faces. Choice (b) has the practical disadvantage that nonisomorphic silver salts find only rare applications in light-sensitive grains and are clearly not favored by the art. Choice (c) has the disadvantage that the overall solubility of the grain is lowered, thereby lowering its rate of development. Further, the location of the lower solubility silver halide is disproportionately detrimental, since latent image formation usually occurs at or near the epitaxy site and hence the lower halide solubility at this site delays the initiation of development.

The present invention provides to the art a photographic emulsion containing grains having {100} crystal faces of improved sensitivity constructed in manner that not only increases their sensitivity but also imparts other desirable performance properties. More specifically, the emulsions of the invention and the process for their preparation avoid the drawbacks of conventional choices (a), (b) and (c) above.

In one aspect the invention is directed to a radiation-sensitive emulsion comprised of silver halide grains having a face centered cubic crystal lattice structure and six {100} crystal faces, wherein a site director containing a benzothiazolium ring with a 5-position electron withdrawing ring substituent is adsorbed to the {100} crystal faces, from 0.5 to 50 mole percent of the total silver forming the face centered cubic crystal lattice structure of the grains is located at intersections of the {100} crystal faces to form protrusions, and the silver halide forming the protrusions exhibits a solubility at least equal to that of the silver halide forming the {100} crystal faces.

In another aspect the invention is directed to a process for the precipitation of a silver halide emulsion in which grain growth is conducted by the introduction of silver and halide ions under conditions that promote the growth of grains having six {100} crystal faces, wherein during the introduction of silver accounting for the final 0.5 to 50 mole percent of total silver precipitated a benzothiazolium site director containing a 5-position electron withdrawing ring substituent is adsorbed to the {100} crystal faces of the grains being grown, so that subsequently deposited silver halide is directed to sites at the intersections of the {100} crystal faces.

One of the highly fortuitous discoveries of the present invention is that the benzothiazolium salts having the 5-position substitution rendering them effective as site directors to achieve the desired grain structures are also members of a class of compounds known to have highly desirable photographic properties. Specifically, benzothiazolium compounds are well recognized to be useful as stabilizers, antifoggants and for improving latent image keeping. Further, the benzothiazolium salt can form one or more nuclei of photographically useful polymethine dyes.

For reasons that are not understood, but are demonstrated in the Examples below, the benzothiazolium salts require 5-position ring substitution to function as site directors. Benzothiazolium salts lacking the required ring substitution are shown in the Examples to be ineffective as site directors.

BRIEF DESCRIPTION OF THE DRAWINGS

FIGS. 2 and 3 are scanning electron micrographs of grains from emulsions prepared with benzothiazolium salts not satisfying the requirements of the invention.

DESCRIPTION OF PREFERRED EMBODIMENTS

Figure 1:
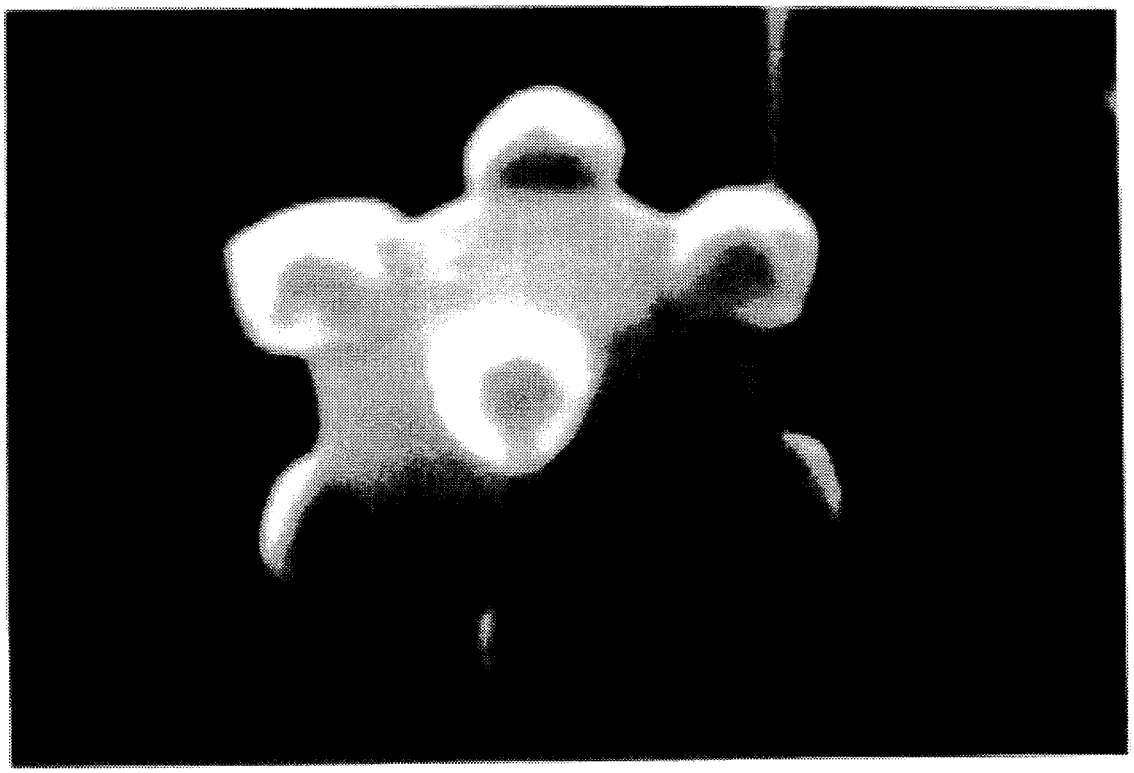
FIG. 1 is a scanning electron micrograph of a typical grain from an emulsion according to the invention.

Through a combination of features the present invention provides the art with radiation-sensitive emulsions of structural forms heretofore thought unattainable and with performance advantages that have not been previously realized. The emulsions of the present invention improve the sensitivity of emulsions having host grains with {100} faces by locating at the intersections of these faces protrusions having a solubility equal to or greater than that of the host grains. The protrusions are formed by precipitating the final increment of silver in the presence of one or more benzothiazolium salts of a substitution pattern rendering them uniquely effective to direct silver salt deposition to the edges and corners of the host grains. Fortuitously the adsorbed benzothiazolium salts capable of acting as site directors are members of a more general class of benzothiazolium salts known to have other photographically useful properties. Hence the adsorbed benzothiazolium salt site directors are capable of serving multiple functions within the emulsion, both during preparation and use.

The host grains can be formed of any silver halide composition known to form a face centered cubic crystal lattice structure. The host grains can be formed solely of silver chloride or solely of silver bromide. They can be formed of mixtures of silver chloride and silver bromide in any proportion. Stated another way, the host grains can be silver bromochloride or silver chlorobromide grains. The host grains can, if desired, contain minor amounts of silver iodide. Iodide can be incorporated in the host grains up to its saturation limit in the face centered cubic crystal lattice structure. Although iodide saturation levels vary, depending on the exact techniques employed for precipitation (particularly precipitation temperatures), the solubility limit of iodide in silver bromide is generally quoted as 40 mole percent, based on silver, while the solubility limit of iodide in silver chloride is generally quoted as 13 mole percent, based on silver. The iodide saturation level in silver chlorobromide and silver bromochloride crystal lattices can be obtained by interpolation knowing the percentage of each halide present. Maskasky U.S. Pat. Nos. 5,238,804 and 5,288,603 disclose techniques for increasing iodide concentrations in face centered cubic crystal lattice structures of silver halide grains beyond conventional levels. Thus, with iodide present the host grains can be comprised of silver iodochloride, silver iodobromochloride, silver bromoiodochloride, silver iodochlorobromide, silver chloroiodobromide or silver iodobromide. Generally as little as 0.5 mole percent iodide, based on silver, is effective to increase photographic sensitivity, although iodide concentrations of at least 1 mole percent, based on silver are preferred for increased sensitivity. It is well recognized that beyond the increment of sensitivity available from iodide inclusion there is an additional increment of sensitivity available from the non-uniform placement of iodide within the host grains. If locally restricted higher iodide concentrations are present in the host grains, they are preferably located within the interior of the grains. Since silver iodide reduces photographic processing rates, it is usually preferred to limit iodide concentrations to less than 5 mole percent, preferably less than 3 mole percent, based on silver. For other effects, such as development inhibition and interimage effects higher iodide concentrations ranging up to 10 mole percent or even 20 mole percent iodide, based on silver, are not uncommon. Generally the highest attainable photographic sensitivities are realized with silver iodobromide grain compositions. Silver chloride grains offer the advantages of the highest obtainable processing rates and lowest native blue sensitivity.

The host grains have six {100} crystal faces. In one preferred form the host grains are cubic grains. That is, they have six {100} faces of equal area. Cubic grains are also sometimes referred to as regular cubic grains. The host grains can also take the form of irregular cubic grains-that is, grains having six {100} crystal faces that are of unequal areas. Irregular cubic grains are in one preferred form tabular grains. Tabular grains with {100} faces satisfying the requirements of this invention can be selected from conventional tabular grain emulsions disclosed by Bogg U.S. Pat. No. 4,063,951, Mignot U.S. Pat. No. 4,386,156, Maskasky U.S. Pat. Nos. 5,264,337 and 5,275,930 and Brust et al EPO 0 534 395. Other irregular cubic grain structures are disclosed by E. Klein, H. J. Metz and E. Moisar, "Formation of Twins of AgBr- and AgCl-Crystals in Photographic Emulsions", *Photographische Korrespondez,* 99, (7), 99–102 (1953).

As precipitated silver halide grains typically exhibit at least some rounding at their corners and often at their edges as well. To achieve optimum siting of the silver halide to be deposited on the host grains it is generally preferred that the {100} faces account for greater than 80 percent (optimally greater than 95 percent) of total grain surface area. In some forms of the invention the host grains can be initially precipitated as octahedral grains and then grown under conditions that favor {100} crystal face emergence until the {100} surface area percentages noted above have been satisfied.

The host tabular grains can be precipitated by any convenient conventional technique. Most commonly and preferably emulsions satisfying host tabular grain requirements are precipitated by a balanced double jet precipitation. In this technique a soluble silver salt, such as silver nitrate, and one or more soluble halide salts, such alkali or ammonium halide, are introduced into a reaction vessel through separate jets while maintaining the halide ion excess within the reaction vessel Within a range that favors the emergence of {100} crystal faces. Another preferred precipitation technique is to introduce seed grains that are sufficiently small to be dissolved in the dispersing medium within the reaction vessel to provide the balanced source of silver and halide ions used for host grain formation. The grains are grown until they have reached an equivalent circular diameter (ECD) equal to or near that sought in the completed emulsion.

Prior to introducing the last 0.1 to 50 percent of the total silver used to form the completed composite grains (host grains with protrusions), a benzothiazolium site director is adsorbed to the {100} crystal faces of the host grains. To be effective as a site director it has been discovered that an electron withdrawing group must occupy the 5-position of the ring structure. One of the commonly accepted techniques of characterizing the electron withdrawing properties of ring substituents is by reference to Hammett sigma values. Substituents that withdraw (accept) electrons from a phenyl ring are assigned positive Hammett sigma values while substituents that inject (donate) electrons to a phenyl ring are assigned negative Hammett sigma values. Lange's Handbook of Chemistry, 12th Ed., McGraw-Hill, 1979, pp. 3–135 to 3–138, here incorporated by reference, lists Hammett sigma values for a large number of commonly encountered substituents. In the interest of definiteness, the Hammett sigma values are herein referenced to reported values for meta position substituents. Alkoxy groups represent a synthetically convenient class of 5-position ring substituents. The number of carbon atoms in the alkyl moiety of this and other alkyl and alkyl moiety containing ring substituents are not critical, but are typically limited to 6 or fewer carbon atoms. The following alkoxy Hammett sigma values are typical: methoxy, $\sigma$=0.14; ethoxy, $\sigma$=0.07; —O—cyclohexyl, $\sigma$= 0.29. Aryloxy substituents, such phenoxy, $\sigma$=0.25, are also contemplated. Preferred 5-position ring substituents are those having a Hammett sigma value of 0.2. Fluorine, $\sigma$=0.34, and chlorine, $\sigma$=0.35, are highly preferred substituents. Bromide, $\sigma$=0.39, and iodide, $\sigma$=0.35, are other possible halogen substituents. Another highly effective and synthetically convenient class of 5-position ring substituents are $\alpha$-haloalkyls, such as —$CCl_3$, $\sigma$=0.47, and —$CF_3$, $\sigma$=0.47. Nitro ($NO_2$, sigma=0.71) groups are also synthetically convenient, but can have a desensitizing effect when benzothiazolium site director is also relied upon for spectral sensitization.

In addition to the 5-position ring substituent the benzothiazolium site director need contain no other substituent, except, of course, the quaternizing substituent of the ring nitrogen atom. The quaternizing substituent can take any convenient conventional form. Simple quaternizing substituents include alkyl groups. Sulfoalkyl and carboxyalkyl quaternizing groups are usually preferred, since they increase solubility. The anionic sulfo and carboxy groups render the benzothiazolium zwitterionic and eliminate the need for a separate charge balancing anion.

In a specifically preferred form the benzothiazolium site director satisfies the following formula:

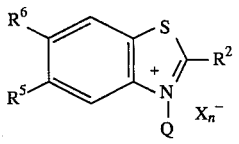

(I)

wherein $R^2$ represents hydrogen or an optionally substituted hydrocarbon;

$R^5$ represents an electron withdrawing substituent;

$R^6$ represents hydrogen, alkyl or an electron withdrawing substituent;

Q represents a quaternizing substituent;

X represents a charge balancing counter ion; and n is 0 or 1.

When $R^6$ is an electron withdrawing group, it can take any of the various forms discussed previously in connection with $R^5$.

$R^2$ can be hydrogen. In other words, the ring need not be substituted at the 2-position. In a simple form $R^2$ can be a hydrocarbon, such as an alkyl, alkenyl or alkynyl group or an aryl group (e.g., phenyl). If desired, the hydrocarbon group can be substituted.

In one specifically preferred form of the invention $R^2$ is chosen to complete a polymethine dye. In other words, $R^2$ at its point of attachment to the 2-position of the benzothiazolium ring contains a methine or substituted methine group and its remaining atoms can be chosen to complete any known polymethine dye that contains at least one benzothiazolium nucleus. That is, the benzothiazolium site director can take the form of a polymethine dye, such as a cyanine, merocyanine, oxonol, hemioxonol or streptocyanine dye. In a specific preferred form of the invention the benzothiazolium site director is a cyanine (including monomethine, carbo and dicarbo cyanine) dye containing two benzothiazolium nuclei, each satisfying the 5-position ring substitution requirements discussed above. A wide variety of polymethine dyes have been employed in photographic emulsions and are available for selection. Exemplary dye are disclosed in *Research Disclosure,* Vol. 308, December 1989, Item 308119, Section IV. *Research Disclosure* is published by Kenneth Mason Publications, Ltd., Dudley House, 12 North St., Emsworth, Hampshire P010 7DQ, England. It is specifically recognized that the benzothiazolium site director when it is selected from among conventional spectral sensitizing dyes can perform the function of a spectral sensitizer in the emulsion formed. When the benzothiazolium site director takes the form of a cyanine spectral sensitizing dye, it is preferably selected from among J-aggregating dyes.

The benzothiazolium site directors can also be selected to perform other photographically useful functions which benzothiazolium salts are known to perform. For example, benzothiazolium salts have been used extensively as antifoggants and stabilizers since their discovery by Brooker in the early 1930's (see Brooker et al U.S. Pat. No. 2,131,038). An illustration of a recent application of this knowledge to high contrast emulsions is disclosed by Mifune et al U.S. Pat. No. 4,237,214. Arai et al U.S. Pat. No. 3,954,478 discloses 2-alkenylbenzothiazolium salts to be useful for latent image keeping. More recently ring opened benzothiazolium salts have been used as stabilizers and for latent image keeping, as taught by Herz U.S. Pat. Nos. 4,423,140 and Freeman et al 4,578,348.

Specific preferred selections of benzothiazolium site directors are provided in Table I below.

TABLE I

| | |
|---|---|
| SD-1 | 5-Chloro-3-methylbenzothiazolium trifluoromethylsulfonate |
| SD-2 | 5-Fluoro-3-(3-sulfopropyl)benzothiazolium p-toluenesulfonate |
| SD-3 | 5,6-Dichloro-2,3-dimethylbenzothiazolium trifluoromethylsulfonate |
| SD-4 | 5,6-Difluoro-3-(3-sulfopropyl)benzothiazolium inner salt |
| SD-5 | 3-(4-Sulfobutyl)-5-trichloromethylbenzothiazolium inner salt |
| SD-6 | 3-Methyl-5-trifluoromethylbenzothiazolium trifluoromethylsulfonate |
| SD-7 | 5-Nitro-3-(3-sulfopropyl)benzothiazolium inner salt |
| SD-8 | 3-Allyl-5-chlorobenzothiazolium hexaphosphate |
| SD-9 | 3-Allyl-5-chloro-2-methylbenzothiazolium hexaphosphate |
| SD-10 | 3-Allyl-5,6-dichloro-2-methylbenzothiazolium hexaphosphate |
| SD-11 | 5-Chloro-2-methyl-3-(3-sulfopropyl)benzothiazolium inner salt |
| SD-12 | 5,5'-Dichloro-3,3'-dimethylthiazolothiacarbocyanine hexaphosphate |

TABLE I-continued

| | |
|---|---|
| SD-13 | Anhydro 3,3'-bis(3-sulfopropyl)-5,5',6,6'-tetrachlorothiazolothiacyanine hydroxide, sodium salt |
| SD-14 | Anhydro 3,3'-bis(sulfopropyl)-6,6'-difluoro-5,5'-dimethyloxythiazolothiacarbocyanine hydroxide, sodium salt |
| SD-15 | Anhydro 5'-fluoro-1,3'-bis(3-sulfopropyl)-naphtho[1,2-d]-thiazolothiacyanine hyroxide |
| SD-16 | Anhydro 3,3'-bis(3-sulfopropyl)-5,5'-difluoro-9-ethylthiazolothiacarbocyanine hydroxide, triethylammonium salt |
| SD-17 | Anhydro 3,3'-bis[(N-ethylsulfonyl)-carbamoylmethyl]-5,5'-dichloro-9-ethyl-thiazolothiacarbocynine hydroxide |
| SD-18 | 1,3-Diethyl-5-[4-(5-chloro-3-ethyl-2-benzo-thiazolinylidene)-2-butenylidene]-2-thibarbituric acid |

The function of the benzothiazolium site director is to adsorb to the {100} crystal faces of the host grains, thereby rendering these crystal faces unable for further grain growth. This directs further silver halide deposition to the edges and corners of the grains, where ripening has exposed submicroscopic crystal face terraces of other orientations for which the site director exhibits less adsorption affinity. Generally effective direction of subsequent deposition to the edges and corners of the host grains can be achieved when the amount of site director corresponds to at least 15 percent of monomolecular coverage of the {100} crystal faces. From the shape and mean ECD of the grains the total grain surface area of the emulsion grains can be calculated. From spectral sensitizing dye studies, including dye aggregation effects, the surface area occupied by a single adsorbed molecule of the site director can identified. From this information the quantity of site director corresponding to monomolecular coverage of the emulsion grain surface area can be calculated. It is generally preferred that the site director be present in a concentration corresponding to at least 25 percent of monolayer coverage of the {100} crystal faces. Ideally 100 percent monolayer coverage of {100} crystal faces with no coverage of the sub-microscopic non-{100} crystal terraces at the corners and/or edges is sought. This assumes perfect site discrimination and also a perfect correlation between calculated and actual site director coverages. It is recognized that the invention does not require either type of perfection, but only useful approximations. In practice it is possible to include site director in concentrations corresponding to 200 percent of monolayer coverage, but preferably the site director is limited to concentrations corresponding to 150 percent of monolayer coverage. With higher concentrations of site director than required to preempt {100} crystal faces the rate of deposition at the corners and edges of the host grains is slowed, and the precipitation rate must be slowed or renucleation (creation of a new grain population) will occur.

After the site director has been adsorbed to the {100} crystal faces of the host grains, additional silver halide deposition is directed to the corners or to the edges and corners of the host grains to form protrusions. Any silver halide can be employed to form the protrusions that (a) exhibits a face centered cubic crystal lattice structure and (b) exhibits a solubility at least equal to that of the host grain. If the host grain emulsion consists essentially of silver chloride, which is the most soluble silver halide, then the protrusions must necessarily also be formed of silver chloride. On the other hand, if the host grains consist essentially of silver iodobromide, with iodide being present at or near its saturation level in the crystal structure, the protrusions can be formed of any one or combination of the silver halides previously discussed as useful in forming the host grains, since with this composition assumption the host grains are of the least soluble of all the possible host grain halide compositions.

One of the distinct advantages of the present invention is that the same silver halide compositions can be employed to form both the host grains and the protrusions. This simplifies precipitation, since the only non-conventional event that need take place during precipitation is the introduction of the benzothiazolium site director at an appropriate interval during precipitation. In a preferred form of the invention the same balanced double jet precipitation procedure is employed before and after introduction of the site director.

To increase significantly the sensitivity of the emulsions it is necessary that the protrusions account for at least 0.5 percent (preferably at least 1 percent) of the total silver forming the completed light-sensitive grains. In the absence of an advantage for higher concentrations silver in the protrusions is limited to 50 percent or less, preferably to 25 mole percent or less.

The protrusions are located in the intersections of the {100} crystal faces of the host grains. The protrusions can be formed at only the corners of the host grains or along the edges as well as at the corners of the host grains. In a preferred form the protrusions can take the form of bulbous nodules. In other embodiments the protrusions appear as a discernible build-up on the {100} crystal faces, but confined to areas near the edges of the host grains.

Apart from the features that have been specifically described the emulsions of the invention and their formation can take any convenient conventional form. A summary of conventional photographic emulsions and procedures for their formation is provided in *Research Disclosure,* Item 308119, cited above.

EXAMPLES

The invention can be better appreciated by reference to the following specific examples.

EXAMPLE 1

A Control

A silver bromide cubic grain host emulsion with a mean 0.76 μm grain edge length was precipitated at pAg 5.8, pH 6.0 and 70° C. using a low (<12 μmole/gram) methionine gelatin peptizer. The host emulsion in the amount of 0.4 mol was added to a reaction vessel mounted with a motor-driven mixer. Five grams of the low methionine gelatin were then added. Distilled water was added next to yield a final weight of 450 g.

Without adding a benzothiazolium site director an overgrowth step was next performed in which 0.5 mol of each of 2.5M $AgNO_3$ and 2.5M NaBr using a balanced double jet procedure. The overgrowth precipitation conditions were pAg 6.7, pH 6.5 and 60° C.

Samples of the emulsion were withdrawn after 25, 50 and 100 percent of the overgrowth silver halide been introduced. Scanning electron microscope (SEM) examinations of the grain samples confirmed that cubic grains with {100} crystal faces were present throughout the overgrowth step.

EXAMPLE 2

An Invention Emulsion

The procedure of Example 1 was repeated, except that the benzothiazolium site director SD-1 was added prior to the overgrowth step in an amount corresponding to 75 percent of monolayer coverage. Prior to introducing SD-1 the pAg and pH were adjusted to the overgrowth values. SD-1 was slowly introduced, and the emulsion was then readjusted to the overgrowth values.

SEM observation of the grains produced revealed that protrusions in the form of nodules had formed at the corners of the host grains. A representative grain is shown in FIG. 1.

EXAMPLE 3

(An Invention Emulsion)

The procedure of Example 2 was repeated, except that the benzothiazolium site director SD-3 was substituted for SD-1 in an amount corresponding to 52 percent of monolayer coverage.

SEM observation of the grains produced revealed that overgrowth had occurred preferentially adjacent the edges and corners of the host grains clearly forming protrusions about the host grain {100} crystal faces.

EXAMPLE 4

An Invention Emulsion

The procedure of Example 2 was repeated, except that the benzothiazolium site director SD-10 was substituted for SD-1 in an amount corresponding to 50 percent of monolayer coverage.

SEM observation of the grains produced revealed that overgrowth had produced nodules similar to those in Example 2 adjacent the edges and corners of the host grains.

EXAMPLE 5

A Control Emulsion

The procedure of Example 2 was repeated, except that the following comparative benzothiazolium salt was substituted for SD-1:

C-1 3-[2-(N-methylsufonyl)carbamoylethyl]-benzothiazolium hexafluorophosphate.

The overgrowth was not directed to the edges or corners of the host grains. A representative SEM view of the grains is shown in FIG. 2. The grains appear highly rounded and almost spherical. The failure of the benzothiazolium salt to act as a site director is attributed to the absence of an electron withdrawing 5-position ring substituent.

EXAMPLE 6

A Control Emulsion

The procedure of Example 2 was repeated, except that the following comparative benzothiazolium salt was substituted for SD-1:

C-2 3-(3-sulfopropyl)benzothiazolium hexafluorophosphate.

The overgrowth was not directed to the edges or corners of the host grains. A representative SEM view of the grains is shown in FIG. 3. The grains appear to be cubooctahedral grains lacking protrusions.

EXAMPLE 7

Emulsions A, B, C and D were prepared by the procedure described in Example 2, but using benzothiazolium compounds C-2, C-1, SD-3 and SD-10, respectively. Further, the host grains contained 3 mole percent iodide, uniformly distributed. The mean edge length of the host grains was 0.42 μm, the reduced size of the grains being attributable to the larger number of grains produced by nucleation in the presence of iodide.

The emulsions were identically sulfur and gold sensitized and spectrally sensitized to the red region of the spectrum. The emulsions were then incorporated into otherwise identical coating formulations using a cyan dye forming coupler, a tetraazaindene antifoggant, additional gelatin, and bis(vinylsulfonyl-methyl)ether hardener. The silver coating coverage in each instance 8.07 mg/dm$^2$, coupler coverage was 9.7 mg/dm$^2$ and total gelatin coverage was 39.3 mg/dm$^2$.

The coatings were identically exposed for 1/25 second with a 5500° K. daylight source through a Wratten 23A filter, which effectively eliminated exposure wavelengths shorter than 560 nm. The exposed coatings were then identically processed using the Kodak™ C-41 Flexicolor process at a development time of 1 minute, 30 seconds. Speed was measured at a density of 0.15 above minimum density and is reported in relative log speed units (30 log speed units= 0.30 log E, where represents exposure in lux-seconds).

The results are summarized in Table II below:

TABLE II

| Emulsion | | Benzothiazolium salt | Final grain shape | Relative Speed |
|---|---|---|---|---|
| A | Control | C-2 | Spherical Grains | 123 |
| B | Control | C-1 | Cubo-octahedral | 118 |
| C | Invention | SD-3 | Corner & Edge Nodules on Cubes | 218 |
| D | Invention | SD-10 | Corner & Edge Nodules on Cubes | 207 |

Since each 0.30 log E difference in speed (30 relative speed units) represents a doubling in speed, the sensitivity advantage exhibited by Emulsions C and D, representing the invention, ranges from >4 times to almost 10 times the speed of the control Emulsions A and B. This demonstrates a significant advantage for restricting the overgrowth silver to the corners and/or corners and edges of the host grains. The results also demonstrate the benzothiazolium site directors employed are compatible with obtaining high levels of photographic performance.

The invention has been described in detail with particular reference to preferred embodiments thereof, but it will be understood that variations and modifications can be effected within the spirit and scope of the invention.

What is claimed is:

1. A radiation-sensitive emulsion comprised of silver halide grains having a face centered cubic crystal lattice structure and six {100 } crystal faces, wherein a site director containing a benzothiazolium ring with a 5-position electron withdrawing ring substituent is adsorbed to the crystal faces, from 0.5 to 50 mole percent of the total silver forming the face centered cubic crystal lattice structure of the grains is located at intersections of the {100} crystal faces to form protrusions, and the silver halide forming the protrusions and the silver halide forming the crystal faces are of the same silver halide composition.

2. A radiation-sensitive emulsion according to claim 1 wherein the protrusions account for from 1 to 15 percent of total silver forming the silver halide grains.

3. A radiation-sensitive emulsion according to claim 1 wherein the silver halide forming the protrusions and the {100} crystal faces is comprised of silver chloride, silver bromide or mixtures thereof.

4. A radiation-sensitive emulsion according to claim 3 wherein the silver halide forming the protrusions and the {100} crystal faces is additionally comprised of silver iodide.

5. A radiation-sensitive emulsion according to claim 1 wherein the benzothiazolium site director is present in a concentration that at monomolecular coverage corresponds to from 15 to 200 percent of the {100} crystal faces.

6. A radiation-sensitive emulsion according to claim 5 wherein the benzothiazolium site director is present in a concentration that at monomolecular coverage occupies from 25 to 150 percent of the {100} crystal faces.

7. A radiation-sensitive emulsion according to claim 1 wherein the 5-position substituent of the benzothiazolium salt exhibits a Hammett sigma value of greater than 0.2.

8. A radiation-sensitive emulsion according to claim 1 wherein the benzothiazolium site director satisfies the formula:

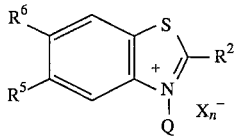

wherein $R^2$ represents hydrogen, hydrocarbon, or the atoms completing a polymethine dye;

$R^5$ represents an electron withdrawing substituent;

$R^6$ represents hydrogen, alkyl or an electron withdrawing substituent;

Q represents a quaternizing substituent;

X represents a charge balancing counter ion; and n is 0 or 1.

9. A radiation-sensitive emulsion according to claim 8 wherein the electron withdrawing substituent is halogen, an α-haloalkyl group or an alkoxy group.

10. A radiation-sensitive emulsion according to claim 9 wherein $R^5$ is chloride and $R^6$ is chloride or hydrogen.

11. A radiation-sensitive emulsion comprised of silver halide grains having a face centered cubic crystal lattice structure and six {100= crystal faces, wherein a site director is adsorbed to the {100} crystal faces, from 0.5 to 50 mole percent of the total silver forming the face centered cubic crystal lattice structure of the grains is located at intersections of the {100= crystal faces to form protrusions, the silver halide forming the protrusions exhibits a solubility at least equal to that of the silver halide forming the {100} crystal faces, and the site director is adsorbed to the {100} crystal faces satisfying the formula:

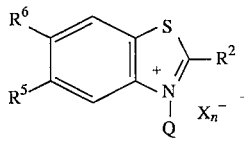

wherein $R^2$ represents hydrogen or hydrocarbon;

$R^5$ represents an electron withdrawing substituent;

$R^6$ represents hydrogen, alkyl or an electron withdrawing substituent;

Q represents a quaternizing substituent;

X represents a charge balancing counter ion; and n is 0 or 1.

12. A radiation-sensitive emulsion according to claim 11 wherein $R^2$ is an alkyl, alkenyl, alkynyl or aryl group.

13. A radiation-sensitive emulsion according to claim 11 wherein the silver halide forming the protrusions and the silver halide forming the {100} crystal faces are of the same silver halide composition.

* * * * *